United States Patent [19]

Tanemoto

[11] 3,984,887

[45] Oct. 12, 1976

[54] PORTABLE COLLAPSIBLE BOAT

[76] Inventor: Keigo Tanemoto, 118, 12-1, Nishihogima 4-chome, Adachi, Tokyo, Japan

[22] Filed: July 17, 1975

[21] Appl. No.: 596,822

[30] Foreign Application Priority Data

July 23, 1974 Japan ..... 49-84392

[52] U.S. Cl. ..... 9/2 C

[51] Int. Cl.[2] ..... B63B 7/00

[58] Field of Search ..... 9/2 C, 2 F, 6 P; 264/DIG. 1

[56] References Cited

UNITED STATES PATENTS

| | | | |
|---|---|---|---|
| 3,225,127 | 12/1965 | Scott, Jr. | 264/DIG. 1 |
| 3,558,417 | 1/1971 | Salyer | 9/6 P |

FOREIGN PATENTS OR APPLICATIONS

| | | | |
|---|---|---|---|
| 1,320,846 | 12/1963 | France | 9/2 C |
| 936,438 | 9/1963 | United Kingdom | 9/2 C |

*Primary Examiner*—Trygve M. Blix
*Assistant Examiner*—Sherman D. Basinger
*Attorney, Agent, or Firm*—Holman & Stern

[57] ABSTRACT

A collapsible boat is integrally molded by blow molding from a flexible synthetic resin material. The boat is normally manufactured into a collapsed form in which the bottom and a first portion of the stern lie on a common plane, and the port and the starboard as well as second and third portions of the stern are folded thereon. When the port and the starboard are erected, the first portion of the stern is simultaneously erected from the bottom into a vertical plane, which is also assumed by the second and third portions of the stern.

3 Claims, 5 Drawing Figures

PORTABLE COLLAPSIBLE BOAT

FIELD OF THE INVENTION

The invention relates to a collapsible boat, and more particularly to a boat which is integrally molded from a flexible synthetic resin material.

BACKGROUND OF THE INVENTION

A collapsible boat which is assembled from several members using special fixtures is known, but the assembly requires a time and labor consuming operation and also requires tools. An inflatable tube boat is also well known, but must be filled with air, requiring a considerable length of time for the filling operation. The length of time or the troublesome operation required for the collapsible boat to be set up for use has been the major disadvantage which prevented a widespread use of the collapsible boat.

SUMMARY AND OBJECTS OF THE INVENTION

Therefore, it is an object of the invention to provide a collapsible boat which is simple in structure and can be easily assembled without the use of special tools.

It is another object of the invention to provide a collapsible boat which may be folded into a flat configuration so as to minimize the required space during shipment or storage.

In accordance with the invention, there is provided a collapsible boat integrally molded from a flexible synthetic resin material and comprising a bottom lying in a single plane and defined by a rectilinear side and a pair of sides which are symmetrical with respect to an imaginary line which intersects perpendicularly with the rectilinear side at the center thereof; a port and a starboard extending from the pair of symmetrical sides, respectively, so as to overlie the bottom and having their terminal edges disposed in opposing relationship on the opposite sides of the imaginary line; and a stern including a first portion in the form of a right-angled equilateral triangle having the rectilinear side of the bottom as its base and extending therefrom in the same plane as the bottom, and a second and a third portion extending from the respective isosceles sides of the triangle to be folded on the first portion and integrally connected with the port and the starboard, respectively, and having their terminal edges disposed in opposing relationship on the opposite sides of the imaginary line.

With the present collapsible boat, when the port and starboard folded so as to overlie, the bottom is erected substantially through 90°, the first portion of the stern is also erected to form an angle of substantially 90° with respect to the bottom, assuming a vertical position in a plane which is common with the second and third portions, thus setting up the boat. A plurality of beams are mounted between the port and the starboard of the set-up boat to protect them from the hydrostatic pressure, thus maintaining the boat in its set-up configuration. The beams also serve as seats for occupants. These beams may be mounted across the port and starboard by forming flutes or ribs on the inside thereof for engagement with the opposite ends of the beams.

The collapsible boat according to the invention is integrally molded from a flexible synthetic resin material, and can be easily and inexpensively manufactured by a known blow molding process.

The above and other objects, features and advantages of the invention will become apparent from the following detailed description of an embodiment thereof shown in the attached drawings, wherein:

DESCRIPTION OF A PREFERRED EMBODIMENT

Figure 1:
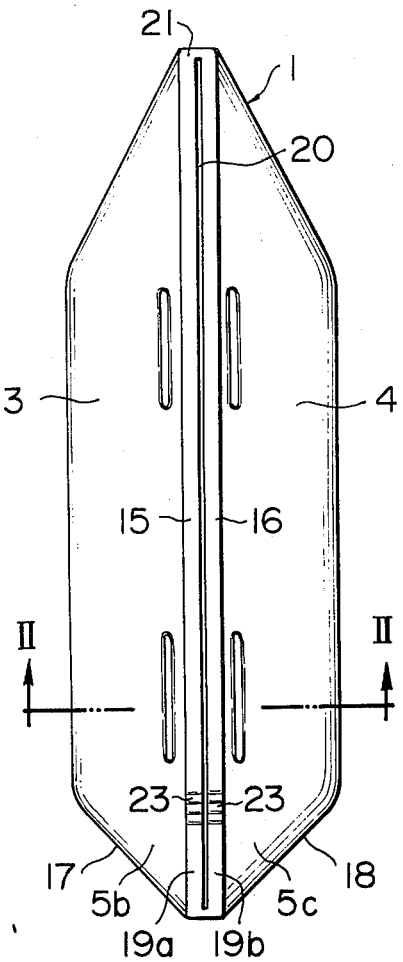
FIG. 1 is a plan view of the boat according to the invention in its collapsed configuration.
Figure 5:
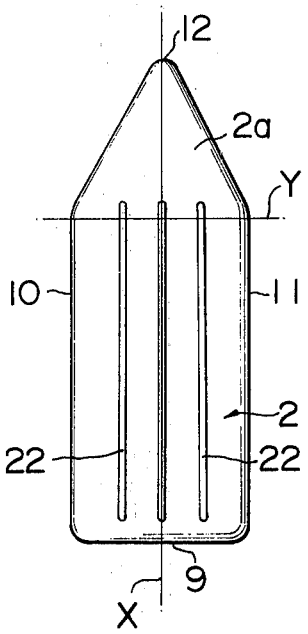
FIG. 5 is a reduced, bottom plan view of the bottom of the boat.
Figure 2:
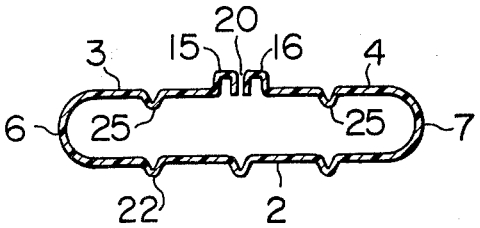
FIG. 2 is a cross section taken along the line II—II shown in FIG. 1.
Figure 3:
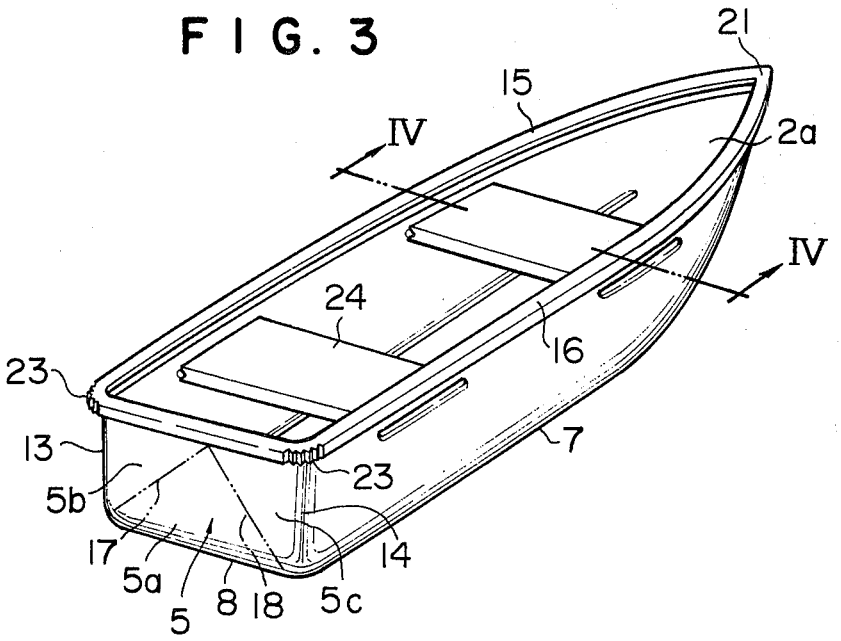
FIG. 3 is a perspective view of the boat according to the invention as it is set up.
Figure 4:
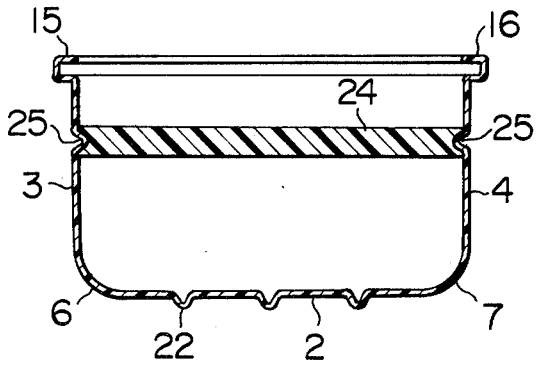
FIG. 4 is a cross section taken along the line IV—IV shown in FIG. 3.

Referring to the drawings, a boat generally shown by reference numeral 1 is integrally molded from a flexible synthetic resin material as by known blow molding. In its normal condition, the boat has a folded appearance as shown in FIG. 1 in which it is manufactured. However, when the boat 1 is set up, it obtains a usual configuration of the boat as shown in FIG. 3, having a bottom 2, a port 3, a starboard 4 and a stern 5. The boundary between the bottom 2 and the port and the starboard 3, 4 as well as the boundary between the bottom 2 and the stern 5 are in the form of rounded ridges 6, 7 and 8, and are therefore not clearly defined as linear line segments. However, the configuration of the bottom 2 can be described as comprising a rectilinear side 9, and a pair of sides 10, 11 which are symmetrical with respect to an imaginary line X which intersects perpendicularly with the rectilinear side 9 at the center thereof, as indicated in FIG. 5. All of these sides normally lie in a single plane. The pair of symmetrical sides 10, 11 intersect with each other at a point 12 on the imaginary line X, but it should be noted that these sides 10, 11 may have a curved configuration joining the point 12 and the opposite ends of the rectilinear side 9. Alternatively, they may comprise a combination of rectilinear line segments. The boundary between the stern 5 and the port and the starboard 3, 4 is also in the form of rounded ridges 13, 14 and is therefore not clearly defined. However, in their normal condition, the port and the starboard 3, 4 extend so as to overlie the bottom 2, with their terminal edges 15, 16 being located opposite to each other. In the normal condition of the stern 5, a first portion **5*a* of the stern which is in the form of a right-angled equilateral triangle having the rectilinear side 9 of the bottom 2 as its base extends therefrom in the same plane therewith, and a second and a third portion 5*b*, 5*c* integrally extend from the respective isosceles sides 17, 18 of the first portion 5*a* so as to be folded over the portion 5*a*. The second and the third portions 5*b*, 5*c* are integrally connected with the port 3 and the starboard 4, respectively, with their terminal edges 19*a*, 19*b* located opposite to each other in the normal condition. As a consequence, in the normal condition of the boat 1, the bottom 2 and the first portion 5*a* of the stern 5 lie in the same plane, while the port 3, the starboard 4 and the second and third portions 5*b*, 5*c* of the stern 5 are disposed opposite to each other in overlying relationship with the first mentioned plane. The terminal edges 15, 16 of the port and the starboard 3, 4 are disposed on opposite sides of the imaginary line X as are the terminal edges 19***a*, 19*b* of the second and third portions 5*b*, 5*c* of the stern 5, thereby forming a single elongate slit 20 therebetween. It will be noted that the first portion 5*a* of the stern 5 may be in the configuration of an equilateral triangle having an apex angle other than the right angles so that the second and third portions 5*b*, 5*c* of the stern 5 lie in different planes.

In use, the port and the starboard 3, 4 may be erected through an angle of nearly right angles with respect to the bottom 2 so as to enlarge the slit 20. At the same time, the first portion 5*a* of the stern 5 is also erected from the bottom 2 through an angle of nearly 90°, whereby the first portion 5*a* as well as the second and third portions 5*b* 5*c* lie in a common vertical plane, thus setting up the boat of the invention. It will be noted that when the port, the starboard and the stern 5 are erected, a forward portion 2*a* of the bottom 2 is raised toward a bow 21, thus assuming an inclined position. When the symmetrical sides 10, 11 of the bottom 2 are curved, the forward portion 2*a* will be deformed into a curved surface. Alternatively, when each of the sides 10, 11 comprises a combination of two rectilinear sides, as shown in FIG. 5, the portion 2*a* will be deformed into an inclined, flat surface in the region from the point 12 to an imaginary line Y shown in this Figure. The bottom 2 may be provided with a suitable number of spray rails 22 which also function as ribs reinforcing the bottom 2. To reinforce the terminal edges 15, 16 and 19 of the port 3, the starboard 4 and the stern 5, it is desirable that these areas be channel-shaped, as illustrated. In this instance, it is desirable to provide concertina connections 23 intermediate the port and the starboard 3, 4 and the stern 5 as well as in the central region of the stern 5 in order to facilitate the folding operation when the boat is set up.

When the boat 1 is thus set up, several beams 24 are attached so as to extend across the port and the starbord 3, 4. These beams engage ribs 25 projecting inwardly from the port and the starboard 3, 4, respectively, thus preventing them from deformation under the hydrostatic pressure and maintaining the boat 1 in its set-up configuration. The beams 24 also serves as seats for occupants of the boat. Alterntively, the port and the starboard 3, 4 may be formed with flutes (not shown) for receiving and engaging with the opposite ends of the beams 24. However, there is no need to use threadable connection or special fixtures since the boat 1 is normally manufactured in is collapsed condition which gives rise to a restoring force across the port 3 and the starboard 4 which is effective to retain the beams 14 in its set-up position. In this connection, it will be noted that when the beams 24 are removed, the boat 1 will be collapsed of itself.

As mentioned previously, the boat 1 is preferably manufactured by the blow molding process. A suitable synthetic resin includes polyethylene, polyvinyl chloride, a mixture of polyethylene and a copolymer of ethylene and vinyl acetate, and a mixture of polyethylene and a copolymer of ethylene and acrylate. To reduce the weight of the boat 1, a blowing agent may be added with the resin so as to form isolated cells, i.e. a foamed material. The molded thickness of the boat 1 depends on the size thereof, but may be on the order of 3 to 10 mm for a boat accommodating two or three occupants.

In one example of manufacturing the boat according to the invention, a mixture comprising 97% by weight of polyethylene and 3% by weight of a copolymer of ethylene and vinyl acetate was prepared. To the mixture was added a blowing agent in an amount of 5 to 10% by weight on the basis of the weight of the mixture. The final mixture was heated into molten state, and then introduced into a mold having an interior hollow space which is configured to correspond to the boat of the invention in its collapsed condition. Compressed air was blown into the hollow space of the mold, thus driving the molten material against the wall of the mold, thus molding the mold. The oppositely located terminal edges 15, 16 of the port and the starboard are joined together as are the opposite terminal edges 19*a*, 19*b* of the stern, which are subsequently severed to form the slit 20.

Since the collapsible boat according to the invention is integrally molded from a flexible synthetic resin material, it has a high buoyance and is free from permeability. The boat according to the invention can be very easily collapsed or set up, and when collapsed, it becomes substantially flat, affording convenience for storage or shipment or portable use, thus rendering it suitable for use as a lifeboat.

Having described the invention, what is claimed is:

1. A collapsible boat integrally molded from a flexible synthetic resin material, comprising a bottom lying in a single plane and defined by a rectiliner side and pair of sides which are symmetrical with respect to an imaginary line which intersects perpendicularly with the rectilinear side at the center thereof; a port and a starboard roundly extending from a respective one of the symmetrical sides so as to overlie the bottom and having their terminal edges disposed opposite to each other and on the opposite sides of the imaginary line; a stern including a first portion in the form of an equilaterial triangle having the rectilinear side as its base and extending therefrom in the same plane as the bottom and a second and third portion roundly extending from each isosceles side of the triangle so as to overlie the first portion and integrally connected with the port and the starboard, respectively, with their terminal edges disposed opposite to each other and on the opposite sides of the imaginary line; and concertina connections provided intermediate said port and said stern, and said starboard and said stern in order to facilitate the folding operation when the boat is set up.

2. A collapsible boat according to claim 1, further including at least one beam member which is mounted across and extends across the port and the starboard when the latter are erected.

3. A collapsible boat according to claim 1 in which the synthetic resin material is a foamed material having isolated cells.

* * * * *